US005614461A

United States Patent [19]

Itoh et al.

[11] Patent Number: 5,614,461

[45] Date of Patent: Mar. 25, 1997

[54] IMAGE FORMATION METHOD USING A REVERSIBLE THERMOSENSITIVE RECORDING MATERIAL

[75] Inventors: Akihide Itoh, Mishima; Toru Nogiwa, Numazu; Yoshihiko Hotta; Akira Suzuki, both of Mishima; Atushi Kutami, Numazu, all of Japan

[73] Assignee: Ricoh Company, Ltd., Tokyo, Japan

[21] Appl. No.: 158,319

[22] Filed: Nov. 29, 1993

[30] Foreign Application Priority Data

Nov. 30, 1992 [JP] Japan ..... 4-345422
Apr. 28, 1993 [JP] Japan ..... 5-124987

[51] Int. Cl.[6] ..... B41M 5/36; B41M 5/28

[52] U.S. Cl. ..... 503/201; 134/9; 134/15

[58] Field of Search ..... 583/201; 134/9, 134/15

[56] References Cited

U.S. PATENT DOCUMENTS 5,087,601 2/1992 Hotta et al. .
5,158,924 10/1992 Konagaya et al. .
5,158,926 10/1992 Hotta et al. .
5,219,820 6/1993 Morohoshi et al. .
5,283,220 2/1994 Kawaguchi et al. .
5,298,476 3/1994 Hotta et al. .

*Primary Examiner*—Pamela R. Schwartz
*Attorney, Agent, or Firm*—Oblon, Spivak, McClelland, Maier & Neustadt, P.C.

[57] ABSTRACT

An image formation method of a reversible thermosensitive recording material capable of reversibly switching its transparency or color tone depending on the temperature thereof is disclosed, which includes the steps of recording images therein at a predetermined image forming temperature, erasing the recorded images from the recording material at a predetermined image erasing temperature, and cleaning the surface of the reversible thermosensitive recording material using cleaning means at substantially the same temperature as the image erasing temperature, with the image erasing step and the cleaning step being carried out substantially at the same time.

12 Claims, 2 Drawing Sheets

IMAGE FORMATION METHOD USING A REVERSIBLE THERMOSENSITIVE RECORDING MATERIAL

BACKGROUND OF THE INVENTION

1. Field of the Invention

The present invention relates to an image formation method, and more particularly to an image formation method using a reversible the thermosensitive recording material which has the property that the transparency or color tone can reversibly be changed depending upon the temperature thereof.

2. Discussion of Background

Recently attention has been paid to a reversible thermosensitive recording material capable of temporarily recording images thereon and erasing the same therefrom when such images become unnecessary. For example, as disclosed in Japanese Laid-Open Patent Applications 54-119377 and 55-154198, there are conventionally known reversible thermosensitive recording materials in which an organic low-molecular-weight material such as a higher fatty acid is dispersed in a matrix resin such as a vinyl chloride-vinyl acetate copolymer resin.

However, this kind of reversible thermosensitive recording material has the shortcomings that it becomes difficult to accurately perform the image formation and erasure in the repeated operation for an extended period of time. This is because when heat and pressure is repeatedly applied to the recording material using heat application means such as a thermal head, dirt and dust are electrostatically attached to the surfaces of the reversible thermosensitive recording material and the thermal head, and a trace of the components contained in the surface portion of the recording material is peeled off and again attached to the surfaces of the recording material and the thermal head.

To solve the above-mentioned problem, a cleaning apparatus for a card-type recording medium is proposed as disclosed in Japanese Laid-Open Patent Applications 3-296981 and 3-296982. More specifically, the surface of the card-type recording medium can be cleaned by a cleaning member which is detachably disposed at a specific position in the image recording apparatus for the card-type recording medium. In addition, there is conventionally known as disclosed in Japanese Laid-Open Patent Application 57-89992 a method of erasing images formed in a reversible thermosensitive recording material by merely immersing it in hot water. This method is not particularly intended to obtain the cleaning effect by the immersion of the recording material in hot water.

However, the reversible thermosensitive recording material cannot be repeatedly used with efficiency for an extended period of time in practice by the above-mentioned conventional methods.

SUMMARY OF THE INVENTION

Accordingly, a first object of the present invention is to provide an image formation method using a reversible thermosensitive recording material of any shape such as a card, sheet or belt, free from the problem that the image formation and erasure cannot sharply be indicated on the recording material by the deposition of dirt and dust on the surface of the reversible thermosensitive recording material.

A second object of the present invention is to provide an image formation method using a reversible thermoseneitive recording material, capable of cleaning the surface of the recording material simultaneously with the erasure of the recorded images.

A third object of the present invention is to provide an image formation method using a reversible thermosensitive recording material, capable of carrying out the image formation and erasure repeatedly with efficiency for an extended period of time by improving the durability of the reversible thermosensitive recording material.

A fourth object of the present invention is to provide an image formation apparatus using a reversible thermosensitive recording material of any shape such as a card, sheet or belt, free from the problem that the image formation and erasure cannot sharply be indicated on the recording material by the deposition of dirt and dust on the surface of the reversible thermosensitive recording material.

The above-mentioned first to third objects of the present invention can be achieved by an image formation method using a reversible thermosensitive recording material capable of reversibly switching its transparency or color tone depending on the temperature thereof, comprising the steps of recording images therein at a predetermined image forming temperature, erasing the recorded images from the recording material at a predetermined image erasing temperature, and cleaning the surface of the reversible thermosensitive recording material using cleaning means at substantially the same temperature as the image erasing temperature, with the image erasing step and the cleaning step being carried out substantially at the same time.

The fourth object of the present invention can be achieved by an image formation apparatus using a reversible thermosensitive recording material capable of reversibly switching its transparency or color tone depending on the temperature thereof, comprising means for recording images in the reversible thermosensitive recording material at a predetermined image forming temperature, means for erasing the recorded images from the recording material at a predetermined image erasing temperature, and means for cleaning the surface of the reversible thermosensitive recording material, which has substantially the same temperature as the image erasing temperature.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
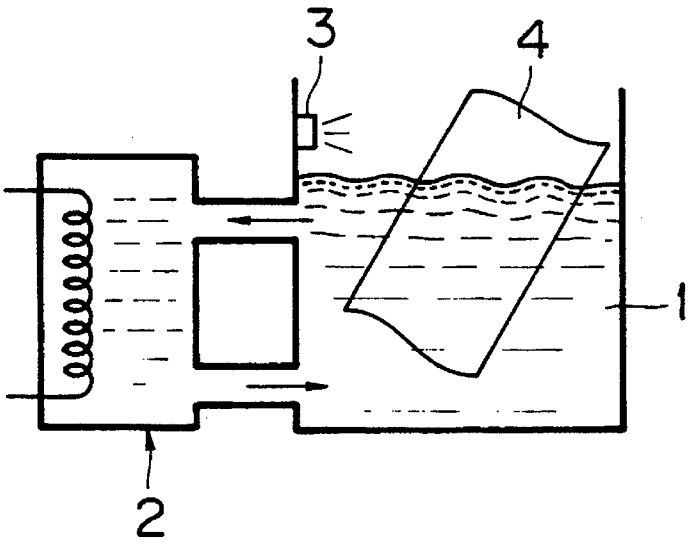
FIG. 1 is a schematic view in explanation of one embodiment of an image formation method according to the present invention.

The reversible thermosensitive recording material for use with the image formation method of the present invention is a material capable of reversibly causing a visual change depending on the temperature of the material. Particularly, in the present invention, the recording material which can reversibly indicate a change in color, not a change in shape is employed. Such a color change of the recording material takes place by the changes of light transmittance, light reflectance, absorption wavelength, and the scattering properties of the recording material. By utilizing the above-mentioned changes of the characteristic properties in combination, the reversible thermosensitive recording material for use in the present invention causes the reversible color change, thereby forming an image therein and erasing the same therefrom.

Any recording materials capable of reversibly changing the transparency or color tone depending upon the temperature thereof are available in the present invention. For example, a reversible thermosensitive recording material comprising two or more kinds of polymers is disclosed in Japanese Laid-Open Patent Application 61-258853, which recording material has the property that the state can be reversibly changed from a transparent state to a white opaque state, and vice versa, because of the difference in compatibility of the polymers. In addition, a reversible thermosensitive recording material comprising a liquid crystal polymer is disclosed in Japanese Laid-Open Patent Application 62-66990, which utilizes the phase change of the liquid crystal polymer.

Furthermore, there are proposed several recording materials, each of which assumes a first color development state at a first predetermined temperature higher than room temperature, and further assumes a second color development state by heating the recording material at a second predetermined temperature higher than the first temperature, and then cooling. This kind of recording material is preferred in the present invention. For example, a recording material which can assume a transparent state at a first predetermined temperature and a white opaque state at a second predetermined temperature is proposed, as disclosed in Japanese Laid-Open Patent Application 55-154198; a recording material which can produce a color at a second predetermined temperature and erase the produced color at a first predetermined temperature, as disclosed in Japanese Laid-Open Patent Applications 4-224996, 4-247984 and 4-247985; a recording material which can assume a white opaque state at a first predetermined temperature and a transparent state at a second predetermined temperature, as disclosed in Japanese Laid-Open Patent Application 3-169590; and recording materials which can assume a black, red or blue color at a first predetermined temperature, and erase the produced color at a predetermined second temperature, as disclosed in Japanese Laid-Open Patent Applications 2-188293 and 2-188294.

Of the above-mentioned reversible thermosensitive recording materials, a recording material which comprises a resin and an organic low-molecular-weight material dispersed in the resin and assumes a transparent state at a predetermined first temperature and a white opaque state at a predetermined second temperature, is preferably employed in the present invention from the viewpoints of sensitivity and durability. Examples of this type of reversible thermosensitive recording material are disclosed in Japanese Laid-Open Patent Applications 63-39378, 63-130380, 2-1363, 64-14079, 3-7377, 63-221087, 63-317385, 2-566, 4-85077, 1-138781 and 3-130188, Japanese Patent Applications 63-14754 and 1-140109, and Japanese Laid-Open Utility Model Application 2-3876.

According to the image formation method using a reversible thermosensitive recording material capable of switching its transparency or color tone reversibly depending upon the temperature thereof, images are recorded in the reversible thermosensitive recording material at a predetermined temperature (hereinafter referred to as the image forming temperature), and the recorded images are erased from the recording material at a predetermined temperature (hereinafter referred to as the image erasing temperature) simultaneously with the cleaning of the surface of the reversible thermosensitive recording material by use of cleaning means. The cleaning means, which may be of wet type or dry type, is heated at substantially the same temperature as the image erasing temperature.

In the case where the wet-type cleaning means is employed for the cleaning step in the image formation method, the reversible thermosensitive recording material may be immersed in a liquid bath of a cleaning liquid, as shown in FIG. 1. In FIG. 1, a reversible thermosensitive recording material 4 is immersed in a liquid bath of a cleaning liquid 1 which is heated by a heating pump 2 at a temperature substantially the see as a temperature at which the images recorded in the recording material 4 can be erased therefrom, that is, the image-erasing temperature. To ensure the cleaning effect, it is preferable that the cleaning liquid 1 be circulated in he liquid bath so that the temperature of the cleaning liquid 1 may be maintained within the image-erasing temperature region, as shown in this embodiment of FIG. 1. Reference numeral 3 indicates an air-blowing member serving to remove the residual droplets of the cleaning liquid 1 from the surface of the reversible thermosensitive recording material 4, which wall be explained later in detail.

Figure 2:
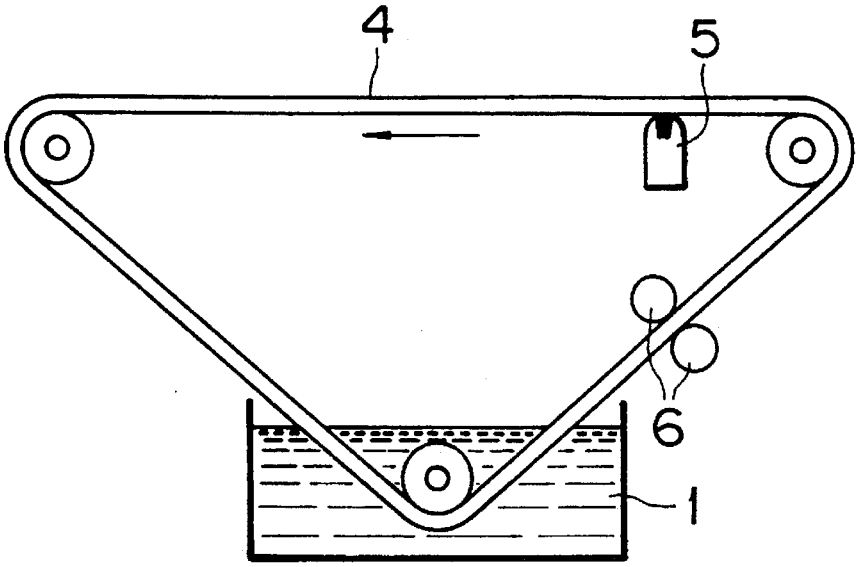
FIG. 2 is a schematic view in explanation of another embodiment of an image formation method according to the present invention.

FIG. 2 is a schematic view of another embodiment in explanation of the cleaning step using a liquid bath. As shown in FIG. 2, images are recorded in a belt-shaped reversible thermosensitive recording material 4 using a thermal head for image formation 5. After the image formation, while the recording material 4 is caused to pass through a liquid bath 1 of a cleaning liquid which is heated at a temperature substantially the same as the image-erasing temperature of the recording material 4, the images recorded in the recording material 4 are erased therefrom, and at the same time the surface of the recording material 4 is cleaned. Reference numeral 6 indicates a pair of rollers for wiping away the residual droplets of the cleaning liquid.

Besides the above-mentioned liquid beth, a cleaning roller, a cleaning belt, a cleaning brush and a cleaning block may be used as the wet-type cleaning means in the present invention. More specifically, the cleaning roller, belt, brush and block used as the wet-type cleaning means comprise a woven fabric, a nonwoven fabric, or a water-absorbing material, which is wetted with droplets of a cleaning liquid. Alternatively, the cleaning roller, belt or block may be entirely or partially immersed in the liquid hath of the cleaning liquid, thereby supplying the cleaning liquid to the cleaning roller, belt or block at any time.

Figure 3:
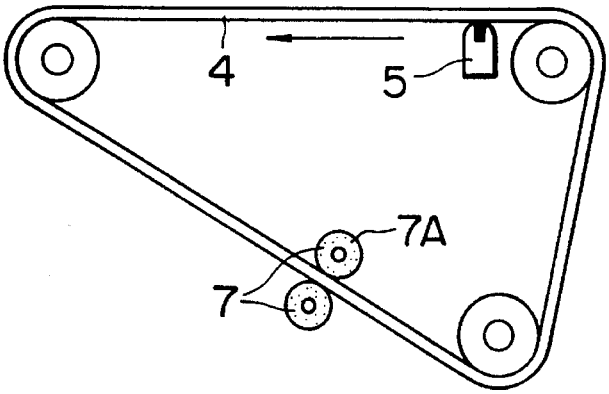
FIG. 3 is a schematic view in explanation of a further embodiment of an image formation method according to the present invention.

FIG. 3 is a schematic view of a further embodiment of the wet-type cleaning means used in the image formation method of the present invention.

As shown in FIG. 3, a belt-shaped reversible thermosensitive recording material 4 is heated to a predetermined image-forming temperature to form images therein by using a thermal head for image formation 5. When the recording material 4 is transported in the direction of the arrow and caused to pass through a pair of rollers 7, the images recorded in the recording material 4 are erased therefrom because one of the rollers 7 which is in contact with the image-bearing surface of the recording material 4 (hereinafter referred to as the upper roller 7A) is heated to a predetermined image-erasing temperature. The upper roller 7A also serves as a cleaning roller, so that the surface of the reversible thermosensitive recording material 4 is cleaned by wiping dirt and dust off with the upper roller 7A.

When the rotational direction of the upper roller 7A is made unidirectional, it is possible for the dirt and dust which have been once wiped off with the upper roller 7A never to return to the surface of the recording material 4. In addition, when the upper roller 7A is detachable, the upper roller 7A can be cleaned or replaced with new one when it becomes dirty.

To improve the cleaning effect, it is desirable that the belt-shaped reversible thermosensitive recording material 4 be caused to pass through the pair of rollers 7 several times. For instance, immediately after the recording material 4 passes through the pair of rollers 7, the transporting direction of the belt-shaped recording material 4 is reversed by changing the rotational direction of one of the rollers 7 which is in contact with the back side of the recording material 4.

In addition to the above, a water-jet method can be applied to the wet-type cleaning step in the present invention. In this case, water may be jetted out to the surface of the reversible thermosensitive recording material at a water pressure of 0.5 $kgf/cm^2$ or more to less than 10 $kgf/cm^2$. In particular, when the water pressure is within the range from 1.0 $kgf/cm^2$ or more to less than 10 $kgf/cm^2$, the striking cleaning effect can be obtained without impairing the recording material.

To heat the wet-type cleaning means at substantially the same temperature as the image-erasing temperature of the reversible thermosensitive recording material to be employed, the cleaning liquid may be heated or the cleaning roller, belt or block may be heated by using heat-application means, for example, a far infrared rays heater.

In the present invention, it is preferable that the step of removing residual droplets of the cleaning liquid from the surface of the reversible thermosensitive recording material (hereinafter referred to as a cleaning liquid removing step) be provided after the cleaning step. When the droplets of the cleaning liquid are removed from the recording material by using dry-type cleaning-liquid removing means, the deposition of dusts on the surface of the recording material can be prevented after the wet-type cleaning operation using the liquid bath, and cleaning roller and the like is carried out. In addition, if the oil smear is attached to the surface of the recording material, contamination of the cleaning liquid by the oils and fats can be prevented by wiping the recording material with the dry-type cleaning liquid removing means.

The residual droplets of the cleaning liquid can be removed from the surface of the reversible thermosensitive recording material by the following methods:

(1) The surface of the reversible thermosensitive recording material is dried by the application of heated air or radiant heat thereto.

(2) The surface of the reversible thermosensitive recording material is wiped with a woven fabric, nonwoven fabric, a rubber blade and the like. As shown in the embodiment of FIG. 2, the residual droplets of the cleaning liquid on the surface of the recording material 4 are removed therefrom by using a pair of rollers 6 comprising the above-mentioned material. In particular, when the surface of the reversible thermosensitive recording material is wiped with a commercially available wiping cloth using microfiber "Miracre" (Trademark), made by Toray Industries, Inc. with a fiber of 0.06 denier, and of approximately 2 μm diameter, the oil smear can be wiped clean and the residual droplets of the cleaning liquid can be removed completely.

(3) The dusts and residual droplets of the cleaning liquid are removed from the surface of the reversible thermosensitive recording material by blowing air over the surface of the recording material, for example, using an air brush. As shown in the embodiment of FIG. 1, the dusts and the residual droplets of the cleaning liquid are removed from the surface of the reversible thermosensitive recording material 4 by the air-blowing member 3.

When the cleaning liquid is employed to clean the surface of the reversible thermosensitive recording material in the wet-type cleaning step, water or a volatile solvent is employed as the cleaning liquid. In particular, an alcohol based volatile solvent, that is, a hydroxy compound prepared by replacing hydrogen in chain-hydrocarbon or alicyclic hydrocarbon with a hydroxyl group is advantageous in the present invention.

Any cleaning liquid with a boiling point higher than a temperature where the reversible thermosensitive recording material to be employed assumes a transparent state and a temperature where the recording material assumes a white opaque state, namely the image-erasing temperature, can be used as the cleaning liquid for use in the present invention. For instance, water, and a volatile solvent evaporating more rapidly than water at room temperature can be preferably employed.

Specific examples of the cleaning liquid for use in the present invention include medium-boiling solvents with a boiling point of 100° to 150° C., such as n-butyl alcohol, isobutyl alcohol, sec-butyl alcohol, n-amyl alcohol, sec-amyl alcohol, methylamyl alcohol, tetrahydrofurfuryl alcohol, dipropyl ketone, methyl propyl ketone, methyl n-butyl ketone, methyl n-amyl ketone, cyclohexanone, methylcyclohexanone, n-butyl acetate, isobutyl acetate, sec-butyl acetate, 3-methoxybutyl acetate, n-amyl acetate, sec-amyl acetate, n-butyl propionate, isopropyl lactate, diethyl carbonate, Cellosolve, methyl cellosolve, diethyl cellosolve, isopropyl cellosolve, Cellosolve acetate, methyl cellosolve acetate, furfural, mesityl oxide, monochlorobenzene, low-flashpoint naphtha, toluene, xylene, Solvesso No. 1, and Solvesso No. 2.

As the cleaning liquid, a mixed solvent of water and the above-mentioned volatile solvent may be prepared by controlling the mixing ratio so that the boiling point of the obtained mixed solvent may be higher than the temperatures where the reversible thermosensitive recording material to be employed assumes a transparent state and a white opaque state.

It is preferable that the cleaning liquid for use in the present invention comprise a surface active agent and/or organic or inorganic finely-divided particles. By the addition of the surface active agent to the cleaning liquid, the cleaning effect on the surface of reversible thermosensitive recording material can be improved. In addition, when the organic or inorganic finely-divided particles are contained in the cleaning liquid, these particles hit against the surface of the recording material, thereby further improving the cleaning effect.

For the organic or inorganic finely-divided particles for use in the cleaning liquid, a material which has no adhesion properties to the surface of the reversible thermosensitive recording material, for example, finely-divided particles of metals such as iron and aluminum and ceramics can be employed. It is preferable that the diameter of these particles be 10 to 500 μm, and more preferably in the range from 50 to 500 μm. This is because these particles of the aforementioned size can be prevented from adhering to the recording material in the course of the cleaning step.

The surface active agents for use in the cleaning liquid are as follows:

(1) Anionic Surface Active Agents

1. Salts of fatty acid such as RCOONa.
2. Higher alcohol sulfuric ester salts such as $ROSO_3Na$.
3. Liquid fatty oil sulfuric ester salts such as $R(OSO_3Na)COOR'$.
4. Aliphatic amine sulfates and aliphatic amide sulfates, such as $RCONHR'CH_2CH_2OSO_3Na$.
5. Aliphatic alcohol phosphoric ester salts such as $ROP(ONa)_2$.
6. Dibasic aliphatic acid ester sulfonates such as

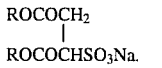

7. Aliphatic amide sulfonates such as $RCONR'CH_2CH_2SO_3Na$.
8. Alkylaryl sulfonates such as

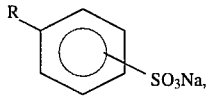

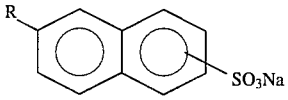

and

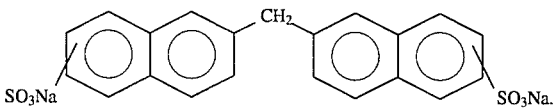

9. Formalin-condensed naphthalene sulfonates.
10. Other anionic surface active agents.

(2) Cationic Surface Active Agents

1. Aliphatic amine salts such as

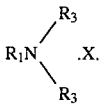

2. Quaternary ammonium salts such as

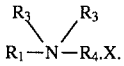

3. Alkyl pyridinium salts such as

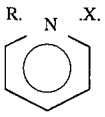

4. Other cationic surface active agents.

(3) Nonionic Surface Active Agents

1. Polyoxyethylene alkyl ethers such as $RO(C_2H_4O)_nH$.
2. Polyoxyethylene alkylphenol ethers such as

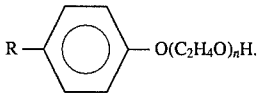

3. Polyoxyethylene alkyl esters such as $RCOO(C_2H_4O)_nH$.
4. Sorbitan alkyl esters such as

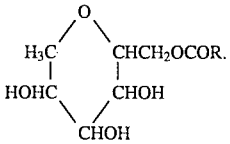

5. Polyoxyethylene sorbitan alkyl esters such as

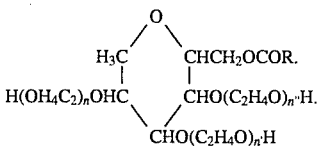

6. Other nonionic surface active agents.

(4) Ampholytic Surface Active Agents (5) Mixtures of Surface Active Agents

1. Anionic mixed surface active agents
2. Cationic mixed surface active agents
3. Nonionic mixed surface active agents
4. Anionic and nonionic mixed surface active agents
5. Cationic and nonionic mixed surface active agents
6. Others As previously mentioned, the dry-type cleaning means can also be used in the cleaning step of the image formation method according to the present invention.

For the dry-type cleaning means, a cleaning roller, a cleaning belt, a cleaning brush and a cleaning block comprising a cleaning portion made of a woven fabric or a nonwoven fabric can be employed. In practice, a dry-type cleaning roller can be prepared by winding an infrared heater with a ceramic pipe so as to form a heated roller and putting a woven fabric on the surface of the pipe. In the case of the cleaning belt, a belt is stretched between the above-mentioned heated rollers to heat the belt to a predetermined image-erasing temperature. The cleaning block can be prepared by putting a nonwoven fabric on the surfaces of a ceramic heater.

In addition to the above, a cleaning roller, belt, brush and block may comprise a cleaning portion comprising an adhesive material and an abrasive material. For instance, when the cleaning means comprising the abrasive material and the adhesive material, the dirt is first scraped off the surface of the recording material by the abrasive material, and then the scraped pieces of dirt and other dusts are attached to the adhesive material, thereby achieving the cleaning of the surface of the reversible thermosensitive recording material.

In the present invention, it is preferable that the surface tension of the reversible thermosensitive recording material to be employed be lower than oils for general use which are smeared on the surface of the recording material. This is because the wetting of the recording material by the oils can be effectively prevented and the oil smears can be easily removed if attached to the surface of the recording material.

The surface tensions of oils for general use range from 31.7 dyn/cm of a repassed oil as a calandering oil to 63.4 dyn/cm of a glycerin as a lubricating oil. In view of these surface tensions, it is preferable that the reversible thermosensitive recording material to be employed in the present invention have a surface tension of 30 dyn/cm or less. Therefore, it is desirable that the reversible thermosensitive recording material comprise a surface layer comprising the following polymers: polytetrafluoroethylene (18.5 dyn/cm), polydimethylsiloxane (24 dyn/cm), polyvinylidene fluoride (25 dyn/cm), poly 1,2-butadiene (25 dyn/cm), poly 2-methylpropane (27 dyn/cm), polyvinyl fluoride (28 dyn/cm), polyvinyl methyl ester (29 dyn/cm) and polypropylene (29 dyn/cm). The above-mentioned values in parentheses indicate the respective surface tensions.

In particular, since the surface tensions of fluorine-containing polymers such as ethylene tetrafluoride are considerably low, they are preferably employed to keep the desired surface tension of the reversible thermosensitive recording material. Such a fluorine-containing polymer with low surface tension may be chemically coated on a protective layer conventionally provided on a recording layer of the reversible thermosensitive recording material, or added to the protective layer as the additive component. In addition, it is possible to fluorinate the surface of the reversible thermosensitive recording material by plasma polymerization and glow discharge.

Other features of this invention will became apparent in the course of the following description of exemplary embodiments, which are given for illustration of the invention and are not intended to be limiting thereof.

EXAMPLE 1

Preparation of Reversible Thermosensitive Recording Material

The following components were mixed to prepare a coating liquid for a reversible thermosensitive recording layer:

| | Parts by Weight |
|---|---|
| Stearic acid (Trademark "C18FA" made by Miyoshi Oil & Fat Co., Ltd.) | 6 |
| Eicosanedioic acid (Trademark "SL-20" made by Okamura Oil Mill Ltd.) | 4 |
| Vinyl chloride-vinyl acetate copolymer (Trademark "Denka Vinyl #1000MT" made by Denki Kagaku Kogyo K.K.) | 20 |
| Tetrahydrofuran | 150 |

The thus prepared reversible thermosensitive recording layer coating liquid was coated on a polyester film with a thickness of about 100 μm, serving as a support, and dried under application of heat thereto, so that a reversible thermosensitive recording layer with a thickness of about 10 μm was provided on the support. Thus, a reversible thermosensitive recording material No. 1 for use in the present invention was obtained.

The reversible thermosensitive recording material No. 1 assumed a white opaque state at room temperature. It was confirmed that the temperature region where the recording material No. 1 assumed a transparent state was from 80° to 105° C.

The recording material No. 1 was heated at 80° C. to make the entire surface of the recording material No. 1 transparent. Using a commercially available line-type thermal head (Trademark "Type KST-256-8w1GD1 1261Ω) made by Kyocera Corp., the thermal energy was applied to the recording material No. 1 for image formation under the conditions that the applied pressure was 4 kgf/A4-size, the applied pulse width was 0.7 msec and the applied voltage was 24 V, so that milky white opaque images were formed against a transparent background.

Several droplets of a cutting oil (cottonseed oil), a lubricating oil (glycerin), a calendering oil (rapeseed oil) and a rust preventing oil (oleic acid) were applied to the surface of the reversible thermosensitive recording material No. 1 in which milky white opaque images were formed, and the recording material No. 1 was allowed to stand at room temperature for one day.

Thereafter, the reversible thermosensitive recording material No. 1 was immersed in a cleaning liquid as shown in FIG. 1, the temperature of which was maintained at 80° C. The cleaning liquid used in Example 1 was prepared by mixing methylamyl alcohol and water in the ratio by weight of (20:80), and adding to the mixed solvent (i) sodium alkylsulfate serving as a surface active agent in the ratio by weight to the above-mentioned mixed solvent of (2:100), and (ii) spherical iron particles with a particle diameter of about 50 μm in the ratio of 100 g of iron particles to 1 liter of the mixed solvent. A commercially available stirrer "Labo-Stirrer Models LR-51 Series", made by Yamato Scientific Co., Ltd. was placed in the liquid bath to stir the cleaning liquid.

When the reversible thermosensitive recording material No. 1 was immersed in the above-prepared cleaning liquid of 80° C., the milky white opaque images were erased, and at the same time the surface of the recording material No. 1 was cleaned. After the recording material No. 1 was taken out of the liquid bath of the cleaning liquid, the recording material No. 1 was caused to pass through a plurality of linearly disposed air nozzles to blow the residual droplets of the cleaning liquid away at an air pressure of 5.0 kgf/cm$^2$.

After the cleaning liquid removing step, the cleaning effect on the recording material No. 1 was visually evaluated by checking the presence of unevenness in the images in the next image formation. The results are shown in Table 1.

Figure 4:
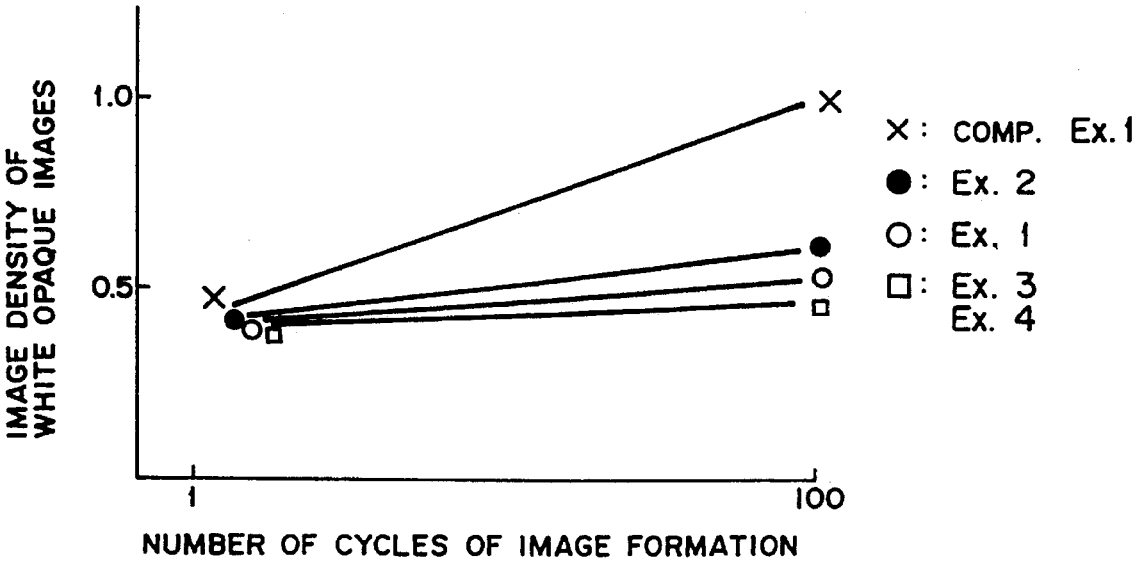
FIG. 4 is a graph which shows the durability of the reversible thermosensitive recording materials in the repeated image formation.

Further, the changes in image density of the white opaque images obtained in the recording material No. 1 were measured in the repeated cycles of image formation. The results are shown in FIG. 4 and expressed as the repetition durability in Table 1.

EXAMPLE 2

A belt-shaped reversible thermosensitive recording material No. 2 was made out of the same reversible thermosensitive recording material No. 1 as obtained in Example 1.

White opaque images were formed in the above-prepared belt-shaped reversible thermosensitive recording material No. 2 and oil smears were applied to the surface of the recording material No. 2 by the same method as in Example 1. After storage for one day, the belt-shaped recording material No. 2 was caused to pass through a pair of rollers 7 which were unidirectionally rotatable, as shown in FIG. 3, so that white opaque images were erased from the recording material No. 2 and the surface of the recording material No. 2 was cleaned.

One of the rollers 7, that is, the upper roller 7A, which served to erase the white opaque images and clean the surface of the recording material No. 2, was made of a ceramic pipe having a far infrared rays heater therein, and the surface of the roller 7A was covered with a nonwoven fabric. The temperature of the upper roller 7A was maintained at 80° C. by the built-in far infrared rays heater, and water pumped by a constant delivery pump was uniformly supplied to the upper roller 7A from linearly disposed spray nozzles, thereby always keeping the upper roller 7A wet.

After the image erasing and cleaning steps, the cleaning effect of the oil smears on the recording material No. 2 was visually evaluated by checking the presence of unevenness in the images in the next image formation by the same method as in Example 1. The results are shown in Table 1.

Further, the changes in image density of the white opaque images obtained in the recording material No. 2 were measured in the repeated operation by the same method as in Example 1. The results are shown in FIG. 4 and Table 1.

EXAMPLE 3

A reversible thermosensitive recording layer was provided on a polyester film with a thickness of about 100 μm in the same manner as that in Example 1.

Fifty parts by weight of a commercially available ultraviolet-curing fluoroplastic solution "DEFENSA 239-1" (Trademark), made by Dainippon Ink & Chemicals, Inc. was diluted with 50 parts by weight of methyl isobutyl ketone to prepare a coating liquid for a surface layer. The thus prepared surface layer coating liquid was coated on the above prepared reversible thermosensitive recording layer, dried and cured by the ultraviolet-light irradiation, so that a surface layer with a thickness of about 3 μm was provided on the reversible thermosensitive recording layer. The surface tension of the surface layer thus provided was 19.6 dyn/cm. Thus, a reversible thermosensitive recording material No. 3 for use in the present invention was obtained.

Using the reversible thermosensitive recording material No. 3, a cycle of image formation, image erasure, cleaning, and cleaning liquid removing steps was repeated in the same manner as in Example 1.

After the cleaning liquid removing step, the cleaning effect of the oil smears on the recording material No. 3 was visually evaluated by checking the presence of unevenness in the images in the next image formation by the same method as in Example 1. The results are shown in Table 1.

Further, the changes in image density of the white opaque images obtained in the recording material No. 3 were measured in the repeated operation by the same method as in Example 1. The results are shown in FIG. 4 and Table 1.

EXAMPLE 4

Using the same reversible thermosensitive recording material No. 1 as that prepared in Example 1, a cycle of image formation, image erasure, cleaning and cleaning liquid removing steps was repeated in the same manner as in Example 1 except that a rubber blade was provided to remove the residual droplets of the cleaning liquid from the surface of the recording material instead of the air nozzles.

After the cleaning liquid removing step, the cleaning effect of the oil smears on the recording material was visually evaluated by checking the presence of unevenness in the images in the next image formation by the same method as in Example 1. The results are shown in Table 1.

Further, the changes in image density of the white opaque images obtained in the recording material were measured in the repeated operation by the same method as in Example 1. The results are shown in FIG. 4 and Table 1.

COMPARATIVE EXAMPLE 1

The white opaque images were formed in the same reversible thermosensitive recording material No. 1 as that prepared in Example 1 and the oil smears were applied to the surface of the recording material in the same manner as in Example 1. After storage for one day, the reversible thermosensitive recording material No. 1 was caused to pass through a pair of heated rollers of 80° C. to erase the white opaque images therefrom.

After the image erasing step, the cleanness of the surface of the recording material was visually evaluated by checking the presence of unevenness in the images in the next image formation by the same method as in Example 1.

Further, the changes in image density of the white opaque images obtained in the recording material were measured in the repeated operation by the same method as in Example 1. The results are shown in FIG. 4 and Table 1.

TABLE 1

| | Cleanness of recording Material (*) | Unevenness of Images in Next Image Formation | Repetition Durability |
|---|---|---|---|
| Ex. 1 | o | Never observed. | o |
| Ex. 2 | Δ | Slightly observed. | o |
| Ex. 3 | o | Never observed. | o |
| Ex. 4 | o | Never observed. | o |
| Comp. Ex. 1 | x | Considerably observed. | x |

(*) Cleanness of the recording material
o: Excellent
Δ: Good
x: Poor

As previously explained, the surface of a reversible thermosensitive recording material was constantly made clear by the cleaning step according to the image formation method of the present invention, so that the sharp images can be indicated on the surface of the recording material.

Furthermore, the cleaning effect on the reversible thermosensitive recording material can be further improved by providing the step of removing the residual droplets of the cleaning liquid for use in the wet-type cleaning step.

What is claimed is:

1. An image formation method using a reversible thermosensitive recording material capable of reversibly switching its transparency or color tone depending on the temperature thereof, comprising the steps of:

recording images therein at a predetermined image forming temperature;

erasing said recorded images from said recording material at a predetermined image erasing temperature; and cleaning the surface of said reversible thermosensitive recording material using a wet cleaning means, using a cleaning liquid, at the same temperature as said image erasing temperature; with said image erasing step and said cleaning step being carried out simultaneously.

2. The image formation method as claimed in claim 1, wherein said cleaning liquid is selected from the group consisting of water, a volatile solvent, and a mixture thereof.

3. The image formation method as claimed in claim 2, wherein said cleaning liquid comprises a surface active agent, and/or organic or inorganic finely-divided particles.

4. The image formation method as claimed in claim 1, wherein the surface of said reversible thermosensitive recording material is cleaned by immersing the same in said cleaning liquid.

5. The image formation method as claimed in claim 1, wherein said cleaning means is selected from the group consisting of a water jet, a cleaning roller, a cleaning brush, a cleaning belt, and a cleaning block.

6. The image formation method as claimed in claim 5, wherein each of said cleaning roller, cleaning brush, cleaning belt and cleaning block comprises a cleaning portion made of at least one material selected from the group consisting of a woven fabric and a nonwoven fabric, said cleaning liquid being supplied to at least one portion of said cleaning portion.

7. The image formation method as claimed in claim 1, further comprising the step of removing said cleaning liquid remaining on said reversible thermosensitive recording material after the cleaning thereof by said wet cleaning means.

8. The image formation method as claimed in claim 7, wherein said cleaning liquid remaining on said reversible thermosensitive recording material is removed by drying under application of heat thereto.

9. The image formation method as claimed in claim 7, wherein said cleaning liquid remaining on said reversible thermosensitive recording material is removed by wiping the same.

10. The image formation method as claimed in claim 7, wherein said cleaning liquid remaining on said reversible thermosensitive recording material is removed by air-blowing.

11. The image formation method as claimed in claim 1, wherein said reversible thermosensitive recording material has a surface tension of 30 dyn/cm or less.

12. The image formation method as claimed in claim 11, wherein said reversible thermosensitive recording material comprises a surface layer comprising a fluorine-containing polymer.

* * * * *

UNITED STATES PATENT AND TRADEMARK OFFICE

CERTIFICATE OF CORRECTION

PATENT NO. : 5,614,461
DATED : MARCH 25, 1997
INVENTOR(S) : AKIHIDE ITOH ET AL

It is certified that error appears in the above-identified patent and that said Letters Patent is hereby corrected as shown below:

Column 1, line 11, delete "the".

Column 4, line 20, "see" should read --same--;
line 24, "he" should read --the--;
line 30, "wall" should read --will--;
line 46, "beth" should read --bath--;
line 54, "hath" should read --bath--.

Column 5, line 12, "with new" should read --with a new--.

Column 8, line 67, "repassed" should read --rapeseed--.

Signed and Sealed this
Ninth Day of June, 1998

*Attest:*

Bruce Lehman

BRUCE LEHMAN

*Attesting Officer*

*Commissioner of Patents and Trademarks*